United States Patent [19]

Jacobsson et al.

[11] 3,944,156

[45] Mar. 16, 1976

[54] THREAD STORAGE AND SUPPLY DEVICE

[75] Inventors: Kurt Arne Gunnar Jacobsson, Ulricehamn; Ove Laursen, Blidsberg, both of Sweden

[73] Assignee: Aktiebolaget IRO, Ulricehamn, Sweden

[22] Filed: Aug. 26, 1974

[21] Appl. No.: 500,459

[30] Foreign Application Priority Data

Aug. 31, 1973 Germany ..... 2343994

[52] U.S. Cl. ..... 242/47.12

[51] Int. Cl.[2] ..... B65H 51/20

[58] Field of Search ..... 242/47.01–47.13; 66/132 R

[56] References Cited

UNITED STATES PATENTS 3,791,598 2/1974 Vischiani et al. ..... 242/47.12

*Primary Examiner*—Stanley N. Gilreath

*Attorney, Agent, or Firm*—Woodhams, Blanchard and Flynn

[57] ABSTRACT

A thread storage and supply device for textile machines comprising a storage drum which is nonrotatably journaled at the free end of an axle, which axle is prevented from rotating by means of a laterally displaced journal pin which extends parallel to the longitudinal direction of the axle and is rotatably positioned in a rotatably journaled disc. The device further comprises a thread supply means which is journaled on the axle, which support means can be set in rotation and which winds the thread upon the storage drum. The rotatably journaled disc is connected, for the purpose of synchronous rotation, to the rotating thread supply means by a connecting pin which is rigidly mounted on the thread supply means and which passes through a radial slot in the rotatably journaled disc. The thread supply means includes a corotational channel for the thread.

5 Claims, 3 Drawing Figures

THREAD STORAGE AND SUPPLY DEVICE

FIELD OF THE INVENTION

This invention relates to an improved thread storage and supply device for a textile machine.

BACKGROUND OF THE INVENTION

This invention relates to a thread storage and supply device for textile machines comprising a storage drum which is nonrotatably journaled at the free end of an axle, which axle is prevented from rotating by means of a laterally displaced journal pin which extends parallel to the longitudinal direction of said axle and is rotatably positioned in a rotatably journaled disc. The device further comprises a thread supply means which is journaled on said axle, which supply means can be set in rotation and which winds the thread upon the storage drum. The rotatably journaled disc is connected, for the purpose of synchronous rotation, to the rotating thread supply means by a connecting pin which is rigidly mounted on said thread supply means and which passes through a radial slot in said rotatably journaled disc. The thread supply means includes a corotational channel for the thread.

A thread supply and storage device is already known (see German publication Offenlegungsschrift No.2 037 031) in which the thread supply means includes a support sleeve which is rotatably journaled on the axle. At the one end thereof facing the storage drum, an annular support plate is positioned whose outer rim projects beyond the winding member and supports a thread eye at this location. At the other end remote from the storage drum, there is positioned a short connecting pin which projects axially and which engages the rotatably journaled disc. The channel for guiding the thread is provided in the form of a cylindrical aperture in the wall of the support sleeve extending from the storage drum remote end over approximately three-fourths of its length. It terminates there in a discharge nozzle which extends downwardly toward the thread eye from the wall of the support sleeve in an outwardly inclined direction. The thread can pass into the opening of the channel remote of the storage drum through a recess in the rotatably journaled disc. This opening is disposed and designed such that it is aligned with the channel opening in each position of the two synchronous, asymmetrically rotating elements: the rotatably journaled disc and the support sleeve. This known device is very expensive in construction in view of the thread guide. The thread supply means requires a channel aperture in a sleeve wall, and the use of a discharge nozzle as well as a support disc with a thread eye. All of these parts must be manufactured separately and assembled. The rotatably journaled disc requires an opening of its own which must have relatively large dimensions. This necessitates an individual production cycle as well. Since perfect passage of the thread with as little friction as possible is important for the mode of function of the device, all parts must be processed and assembled with particular care. The result is a considerable expenditure of work and a corresponding increase in costs. Since storage and supply devices of this type are required in large numbers for modern textile machines, this expenditure plays a considerable economic role.

The object of the invention is to provide a thread storage and supply device of the type recited at the outset which demonstrates a construction which is both simple and economical.

This object is accomplished in accordance with the invention in that the connecting pin contains the channel for the thread.

Using a tubular body as the connecting pin results neither in a considerable increase in costs nor in the time necessary for assembly, since the connecting pin had to be manufactured and assembled separately in any case. Even if an aperture had been provided in the body of the thread supply means in place of the tubular connecting pin in order to provide a possibility for emergence of the thread, the requirements made on the tolerance exactness and surface quality of this aperture are considerably lower than for an aperture which forms the channel directly. An essential advantage is that the connecting pin passes through the rotatably journaled disc in a radial slot and acts on the walls thereof so as to transmit the rotary movement. If the connecting pin contains a channel, this channel is accessible at all times for the thread and another opening in the rotatably journaled disc is not necessary, thereby leading to a further reduction in construction costs in an economical manner.

In an advantageous further development of the inventive device, the connecting pin with the channel for the thread extends from the side of the rotatably journaled disc which is remote of the storage drum to the level of the storage drum in a continuous manner and runs parallel to the axle somewhat outside the imaginary extension of the storage drum external surface. This embodiment has two essential advantages as compared to the known device described at the outset: on the one hand, the thread is transported in a straight line from the location where it enters the device up to the storage drum, thereby producing no deviations in the path of the thread which would lead to friction. Moreover, the construction of the device is simplified considerably. The connecting pin designed as a tubular body of sufficient length is a structural element which is simple in manufacture and assembly and also eliminates elements which are considerably more difficult to manufacture and assemble, i.e. an inclined discharge nozzle and a thread eye. The connecting pin can be secured in or on the thread supply means in a simple way, since an aperture provided for the pin is continuous in any case and thus easy to provide.

BRIEF DESCRIPTION OF THE DRAWINGS

Embodiments of the inventive thread storage and supply device are illustrated in the drawings, in part in sectional elevation, in which.

DETAILED DESCRIPTION

Figure 1:
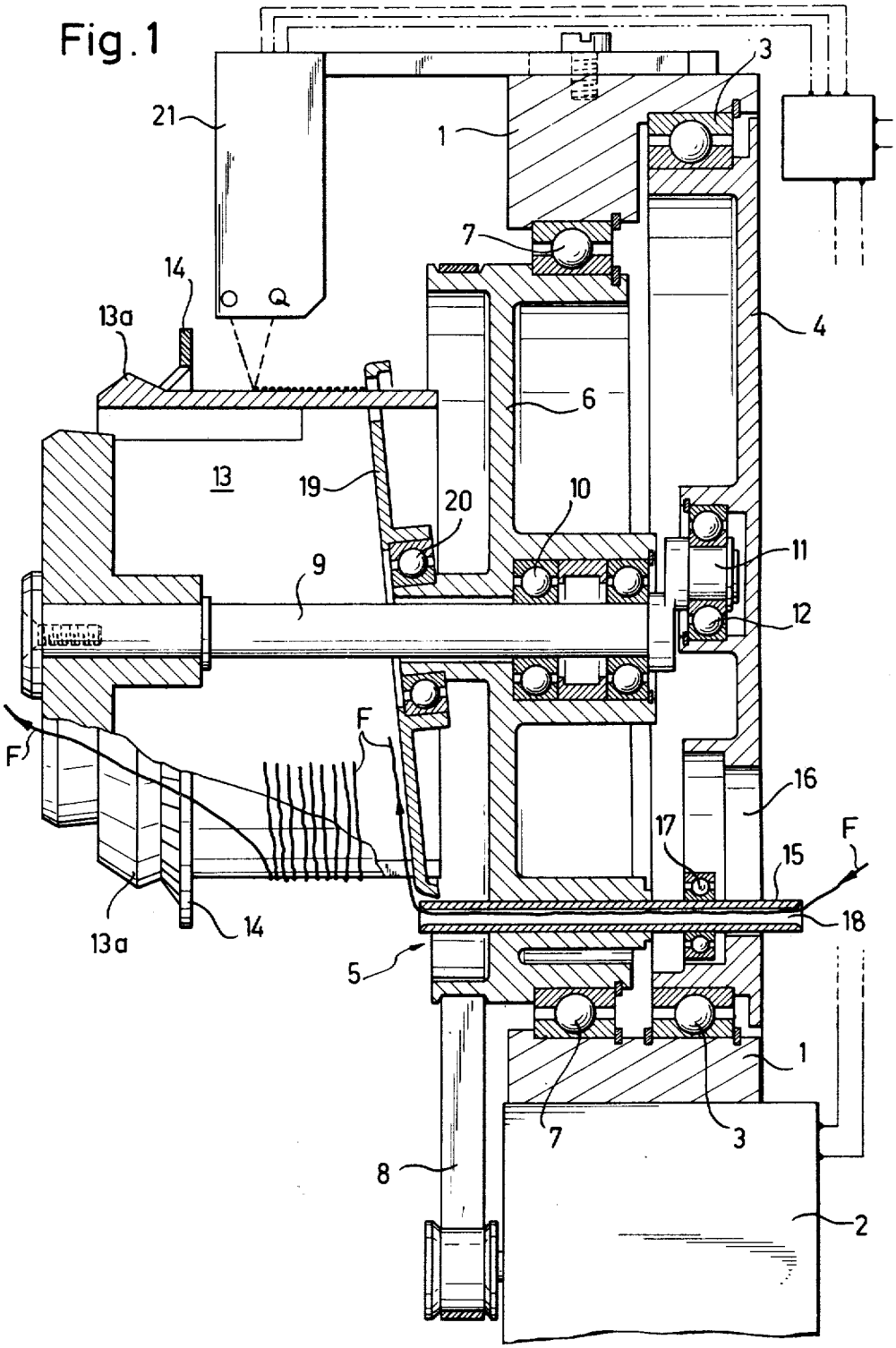
FIG. 1 is a first embodiment of an inventive device.

The device according to FIG. 1 includes a housing to which a motor 2 is secured. A disc 4 is rotatably journaled in the housing 1 by means of ball bearings 3. A thread supply means, which is designated in its entirety by number 5, includes a support member 6 which is rotatably journaled in the housing 1 by means of bearings 7 and which is coupled to the motor 2 by means of a driving belt 8. The plane of rotation of the support member 6 is parallel to the plane of rotation of the rotatably journaled disc 4, the centers of rotation of both elements, however, are offset laterally relative to one another.

An axle 9 is freely journaled in the support member 6 with ball bearings 10 at its one end region. At this end near the bearings, it also includes a bearing pin 11 which lies parallel to the longitudinal direction of the axle, which is displaced laterally and which is journaled in the rotatably journaled disc 4 by means of bearings 12. The axle 9 is prevented from rotating relative to the housing 1 due to this double eccentric journaling arrangement. The free end of axle 9 has a storage drum for the thread F secured thereto so as to prevent rotation thereof. The storage drum is designated in its entirety by number 13. The drum has a substantially cylindrical design and a bead 13*a* in the area remote of the housing. A conventional elastic braking ring 14 is supported against said bead 13*a*.

A tubular connecting pin 15 is associated with the thread supply means 5. The pin is fixedly secured in the support member 6 so as to be parallel to the axle 9, and passes through a radial slot 16 in the rotatably journaled disc 4. The end of pin 15 is movably supported on the sidewalls of slot 16 by means of a ball bearing 17. The connecting pin 15 has one end which projects beyond the surface of the rotatably journaled disc 4. It projects beyond the support member 6 at the other end. The distance between the connecting pin 15 and the axle 9 is somewhat larger than the radius of the storage drum 13. The hollow interior of the connecting pin 15 forms a channel 18 for the thread F.

The thread supply means 5 also includes a conventional swash ring 19 which is rotatably journaled on the support member 6 in bearings 20 and which surrounds the area of the storage drum 13 near the support member 6 in a direction which is inclined relative to the axis thereof. Its plane of relative rotation is inclined relative to the plane of rotation of said support member. The device is also associated with a thread storage control means 21 which operates with a photocell.

The mode of function of the recited thread storage and supply device is as follows:

OPERATION

The motor 2 drives the support member 6 and causes it to rotate. This movment which is concentric relative to the axle 9 results in the connecting pin 15 moving along a circular path about the axle 9. In so doing, it pulls the rotatably journaled discs 4 along with it, thereby causing said disc to rotate synchronously and parallel, but eccentrically, relative to the support member 6. A relative motion takes place between the connecting pin 15 and the walls of the radial slot 16. The axle 9 and thus the storage drum 13 remain stationary, since the torque acting on the axle 9 is absorbed by the bearing pin 11.

The thread F, which passes through the channel 18 of the connecting pin 15, is moved in a circle about the storage drum as it emerges from the outlet near the storage drum, whereby the thread is wound upon the drum. The swash ring 19 ensures that the windings are pushed toward the free end (leftward end in FIG. 1) of the storage drum where the bead 13*a* prevents them from slipping off. The thread F is removed from underneath the braking ring 14 in a horizontal direction (i.e., axially of the drum). The thread storage control means 21 monitors the number of windings wound on the storage drum and de-energizes the motor 2, thus stopping the winding process, when a predetermined number of windings has been attained.

The invention is not limited to the illustrated embodiment. For example, the details in the arrangement and journaling of the disc 4, in the support member 6 and in the swash ring 19 may be varied as desired as well as in the design of the storage drum 13. The embodiment according to FIG. 2 coincides substantially with that according to FIG. 1. Thus, corresponding parts have been provided with the same reference numerals and therefore do not need to be described once again.

Figures 2, 3:
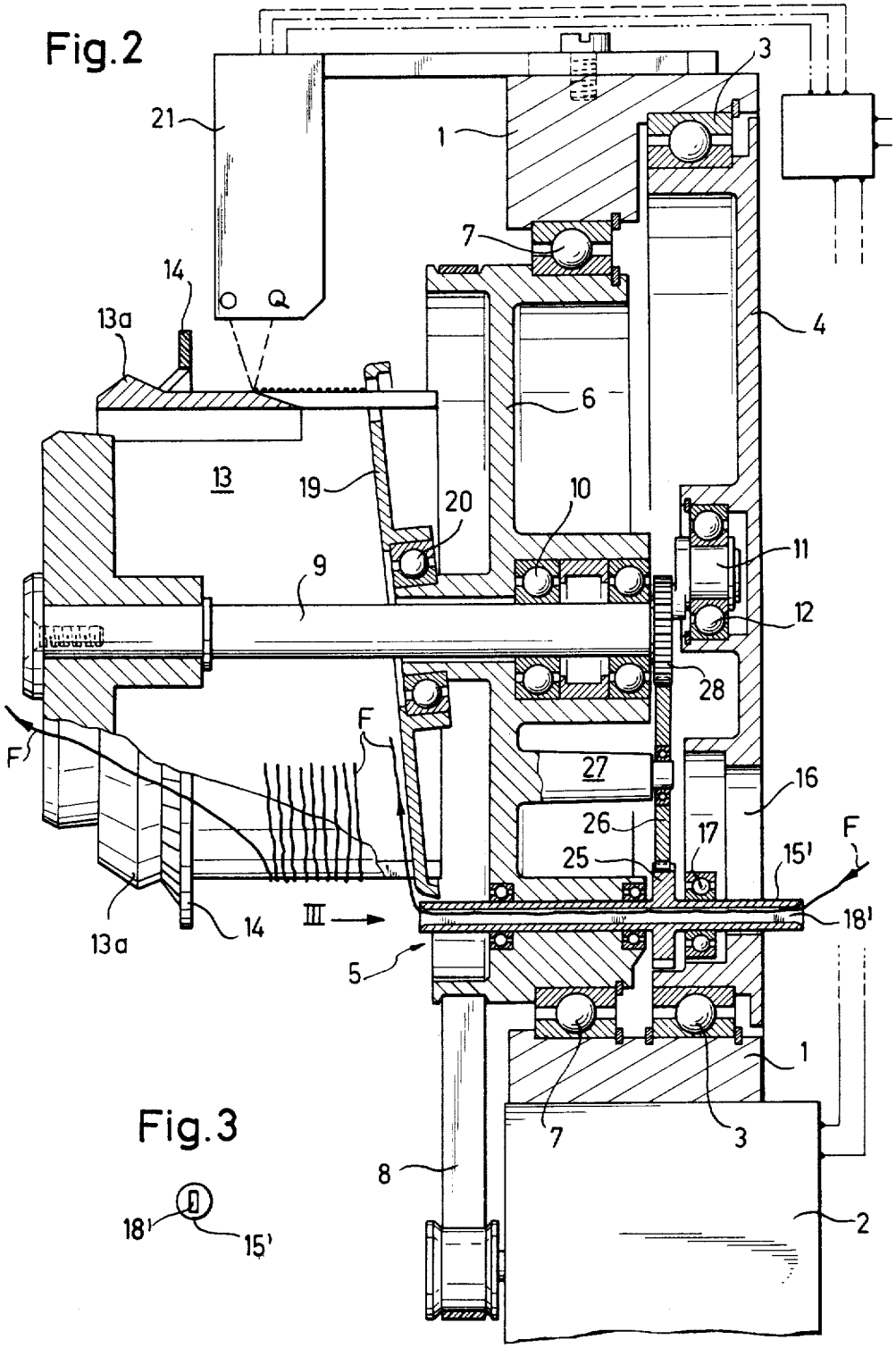
FIG. 2 is a second device suitable for web-like yarn.
FIG. 3 is a partial front elevation of FIG. 2 corresponding to arrow III shown in FIG. 2.

Unlike the device according to FIG. 1, the one according to FIG. 2 includes a channel 18′ of rectangular cross section in the connecting pin 15′ as is clearly illustrated in FIG. 3, and pin 15′ is rotatably journaled on support member 6, as by ball bearings. A gear 25 is fixedly secured to the rotatably journaled connecting pin 15′. This gear 25 meshes with an intermediate gear 26 which is rotatably journaled on a pin 27 of the support member 6. The intermediate gear 27 in turn meshes with another gear 28 which is fixedly secured to the axle 9. The device according to FIG. 2 is especially suitable for web-like yarn which is held in the rectangular cross section of the channel 18 so as to prevent twisting. The connecting pin 15 is always maintained in a specific relative position with respect to the surface of the storage drum 13 due to the gear train 25–28. That is, the channel 18′ remains in a fixed (for example, vertical) orientation at all times even though the pin 15′ is moved in a circular path around the drum. Thus, the web-like yarn is twisted only once when being wound onto the storage drum. This single twist is eliminated during unwinding from the drum.

The control of the pin containing the channel 18′ by means of a gear train (transmission) so that the channel together with its rectangular cross section always assumes a definite position relative to the drum surface may also be provided when the pin only serves to conduct the yarn and a separate connecting pin is provided for connecting the disc 4 and support member 6 for joint rotation.

Although a particular preferred embodiment of the invention has been disclosed above for illustrative purposes, it will be understood that variations or modifications thereof which lie within the scope of the appended claims are fully contemplated.

The embodiments of the invention in which an exclusive property or privilege is claimed are defined as follows:

1. A thread storage and supply device for a textile machine, comprising an axle having means associated with one end thereof for maintaining the axle in a nonrotatable condition, the axle having a free end portion adjacent the other end thereof, a thread storage drum nonrotatably mounted relative to said axle and disposed in surrounding relationship to the free end portion thereof, supply means for permitting a thread to be wound onto said drum, said supply means including a thread supply member disposed adjacent one end of said drum and rotatably journaled on said axle for rotation about the axis thereof, rotatable disc means disposed adjacent said supply member on the side thereof remote from said drum, said disc means being rotatable about an axis which is parallel to but radially displaced from the axis of said axle, and means drivingly interconnecting the disc means and the supply member for synchronous rotation, the improvement wherein said interconnecting means includes a thread guide pin mounted on the thread supply member and passing through a radial slot formed in said disc means so that the thread guide pin passes axially through both the supply member and the disc means, the thread guide pin having a channel extending axially therethrough for permitting passage of a thread which is to be wound on the drum.

2. A device according to claim 1, wherein the thread guide pin extends continuously from the side of the disc means remote from the storage drum to a point located adjacent the outer thread storage surface of the drum, said thread guide pin extending parallel to the axis of said axle but being positioned outside of an imaginary extension of the storage drum outer surface.

3. A device according to claim 1, wherein the channel has a flat rectangular cross section, wherein the thread guide pin is rotatably supported on the supply member, and gear means drivingly connected to said thread guide pin for maintaining said pin and the slot therein in a constant relative position with respect to the surface of the storage drum.

4. A device according to claim 1, wherein the means for preventing rotation of the axle includes a journal pin which is fixed to the axle and radially displaced therefrom and extends parallel to the axis thereof, said journal pin having said disc means rotatably journaled thereon and defining the rotational axis of said disc means.

5. A device according to claim 3, wherein the gear means is formed from a first gear which is rigidly secured on the axle of the storage drum, an intermediate gear which meshes with said first gear and is rotatably journaled in a part which rotates with the guide pin, and a second gear which meshes with said intermediate gear and which is rigidly mounted on said guide pin.

* * * * *